United States Patent [19]

Cozzini

[11] 4,038,782

[45] Aug. 2, 1977

[54] HONING MECHANISM

[76] Inventor: Artemio S. Cozzini, 3464 N. Dousman, Milwaukee, Wis. 53212

[21] Appl. No.: 628,362

[22] Filed: Nov. 3, 1975

[51] Int. Cl.[2] ..... B24B 3/54

[52] U.S. Cl. ..... 51/5 D; 51/80 BS

[58] Field of Search ..... 51/5 D, 80 R, 80 A, 51/80 B, 80 BS, 83 BS, 84 BS, 83 R, 84 R

[56] References Cited

U.S. PATENT DOCUMENTS

| | | | |
|---|---|---|---|
| 97,664 | 12/1869 | Marsh | 51/84 R X |
| 2,456,482 | 12/1948 | Barnard et al. | 51/83 R |
| 2,561,004 | 7/1951 | Wilson et al. | 51/84 R |
| 2,648,174 | 8/1953 | Bikles | 51/80 BS |
| 3,758,993 | 9/1973 | Kirts | 51/80 BS |

*Primary Examiner*—Harold D. Whitehead
*Assistant Examiner*—K. J. Ramsey
*Attorney, Agent, or Firm*—Andrus, Sceales, Starke & Sawall

[57] ABSTRACT

A honing mechanism for honing blades which includes a pair of honing wheels mounted on carriages for movement in a direction toward and away from each other between an operating or honing position and a dressing position. Each honing wheel is driven by a cog belt from a sprocket, and the sprockets are splined to a drive shaft, so that as the honing wheels are moved between the honing position and the dressing position the sprockets will move along the splined drive shaft to maintain the proper tension on the drive belt. A dressing mechanism is incorporated which acts to remove a controlled amount of the surface of each honing wheel when in the dressing position and to return the honing wheels to the proper grinding position by automatically compensating for the amount removed from the surfaces of the wheels during the dressing operation.

19 Claims, 9 Drawing Figures

Fig. 1
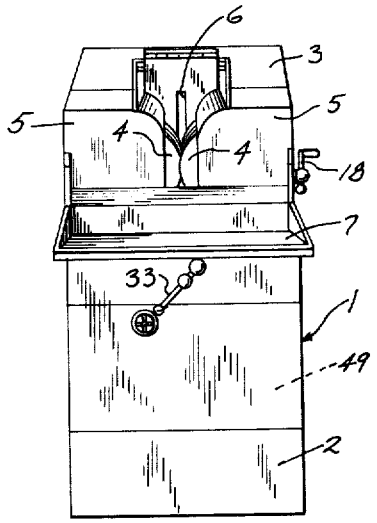
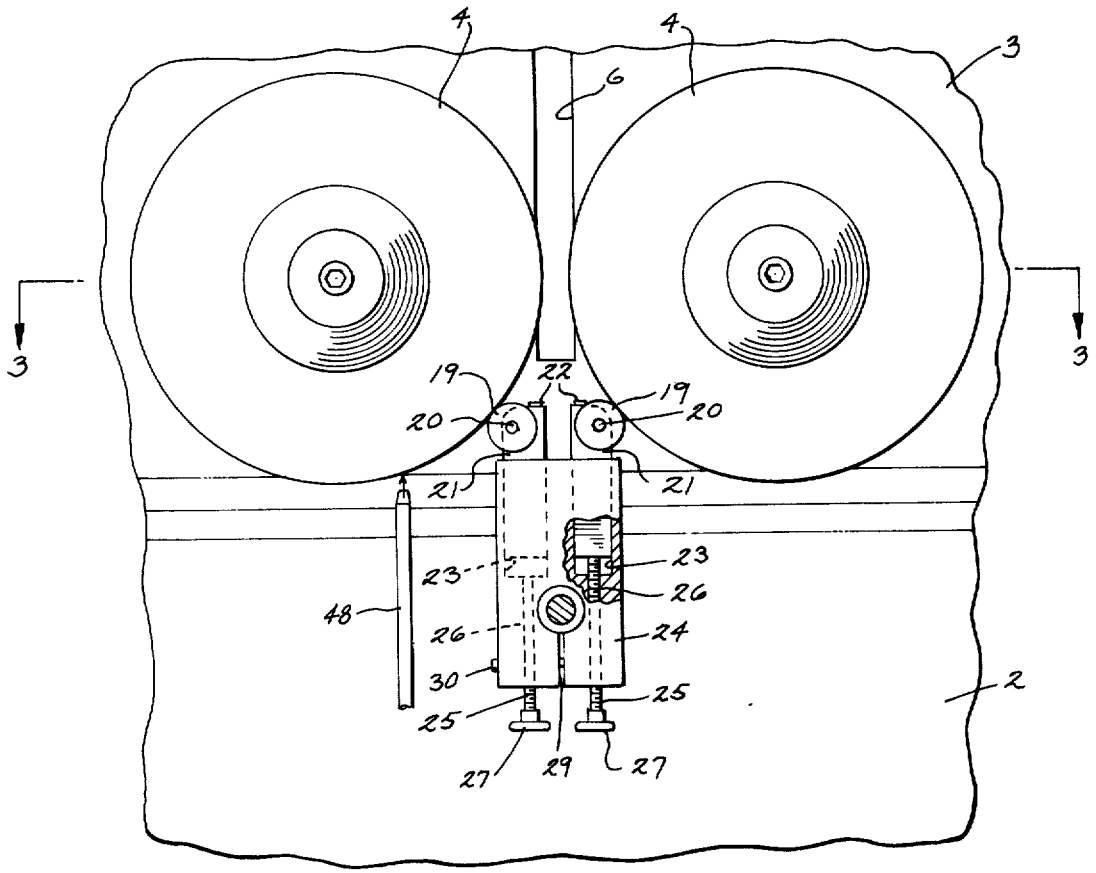
Fig. 2

Fig. 4
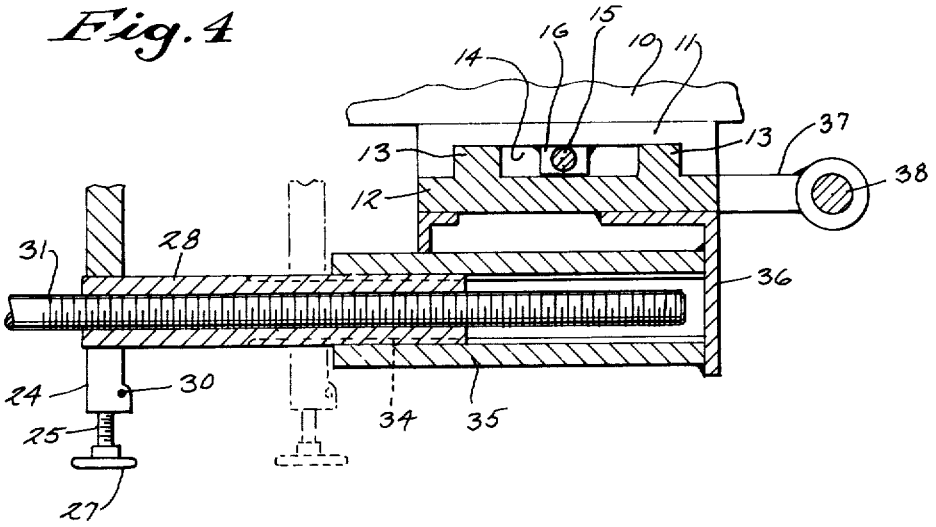
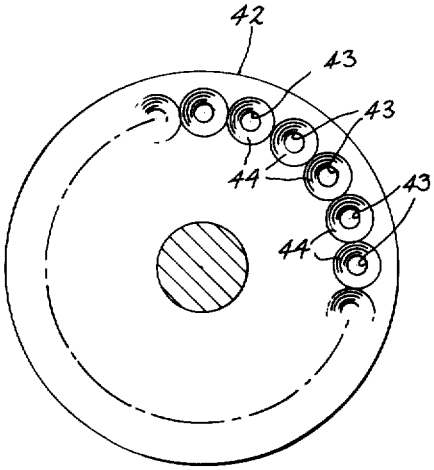
Fig. 5
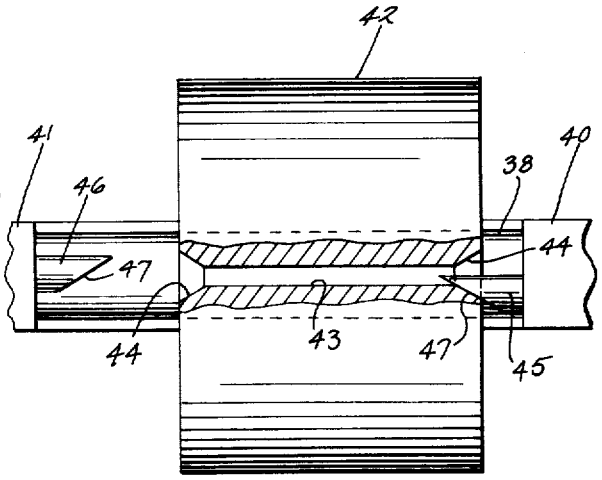
Fig. 6
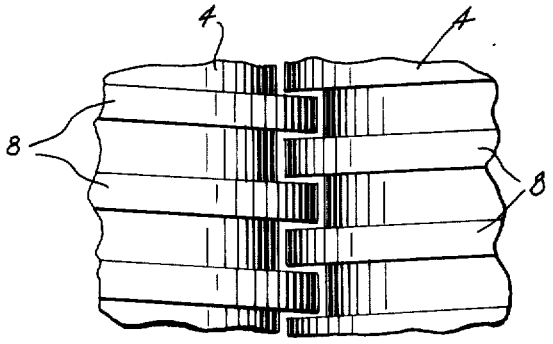
Fig. 7

HONING MECHANISM

BACKGROUND OF THE INVENTION

The conventional honing machine for honing blades includes a pair of cooperating honing wheels, each having mating or cooperating spiral threads or ribs and the blade to be honed is inserted between the wheels. In operation, the surfaces of the honing wheels tend to glaze over and it is necessary to periodically dress the surfaces of the honing wheels to remove metallic deposits and foreign materials. In the conventional honing machine, the honing wheels are moved laterally apart and individually dressed by passing diamond-tipped dressing members across the surfaces of the wheels. The dressing operation has traditionally been a cut-and-try method in which the dressing members were manually positioned with respect to the honing wheels for dressing, and the honing wheels were then returned to the honing position and set in the honing position through visual observation.

As the honing wheels are normally driven through a common motor or drive source, a problem has arisen in the past in maintaining the driven connection to the honing wheels as the wheels are moved laterally between the honing and dressed positions.

SUMMARY OF THE INVENTION

The invention relates to a honing machine which incorporates an improved drive system and has a dressing mechanism that removes a controlled amount from the surface of each grinding wheel and thereafter returns the wheels to the proper grinding position, by compensating for the amount of surface removed from the wheels in the dressing operation.

More specifically, the honing machine includes a cabinet or frame and a pair of honing wheels are mounted for sliding movement on carriages in a lateral direction between an operating or honing position, in which the spiral threads of the honing wheels are in mating engagement, and an outer or dressing position.

The axes of the honing wheels are located perpendicular or normal to the axis of a splined drive shaft and each honing wheel is driven by a cog belt from a sprocket that is splined to the drive shaft. The cog belts are provided with an opposite twist so that as the honing wheels are moved between the honing position and the dressing position, the sprockets will slide along the splined shaft to maintain the proper belt tension on the drive belts during the movement. This drive eliminates the need for a transmission or any other involved driving system.

The dressing mechanism includes a pair of dressing wheels which are mounted on a slide. When the honing wheels are in the dressing position, the slide is moved in its path of travel and the dressing wheels ride along the surfaces of the respective honing wheels to remove a controlled amount from the surface of the wheels. After dressing, the honing wheels are returned to the honing position and the mechanism acts to automatically position the wheels in the proper alignment by compensating for the amount of the surface removed from each wheel in the dressing operation.

The activating system for the dressing mechanism includes two wedge-shaped pins that move with the carriage of one of the honing wheels. As the carriage moves from the honing position to the dressing position, one of the pins engages the beveled edge of one of a series of holes in a stop which is secured to a rod that is threaded into the fixed base member. Engagement of the pin with the hole at the end of the stroke of travel of the carriage will act to rotate the stop through a slight arc to reposition the stop. When the carriage returns from the dressing position to the honing position, the other pin acts in a similar manner to again rotate the stop through a slight arc ahd reposition the stop. By automatically repositioning the stop, the spacing between the axes of the honing wheels, when moved to the outer dressing position, will be slightly less than the spacing during the previous dressing operation to compensate for the amount of surface removed in the previous dressing operation and thereby properly align the honing wheels with the dressing wheels. Similarly each time the honing wheels are returned to the honing position, the spacing between the axes of the wheels will be reduced a slight increment to compensate for the amount of the surface removed in the dressing position.

Thus, the dressing mechanism of the invention automatically enables a controlled layer to be removed from the surface of each honing wheel in the dressing operation and automatically returns the wheels to the proper honing position, taking into consideration the amount of surface removed in the dressing operation. The mechanism completely eliminates the need for manual adjustment of the dressing mechanism and the honing wheels, which has been required in prior honing machines.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the honing machine with the cover members in place;

FIG. 2 is a vertical section with parts broken away in section showing the honing wheels in the outer or dressing position;

FIG. 4 is a section taken along line 4—4 of FIG. 3;

FIG. 5 is a section taken along line 5—5 of FIG. 3;

FIG. 6 is a section taken along line 6—6 of FIG. 3 and showing the wedge-shaped pin engaging a hole in the stop;

FIG. 7 is a fragmentary top view of the honing wheels showing the wheels in the honing position;

DESCRIPTION OF THE PREFERRED EMBODIMENT

Figure 3:
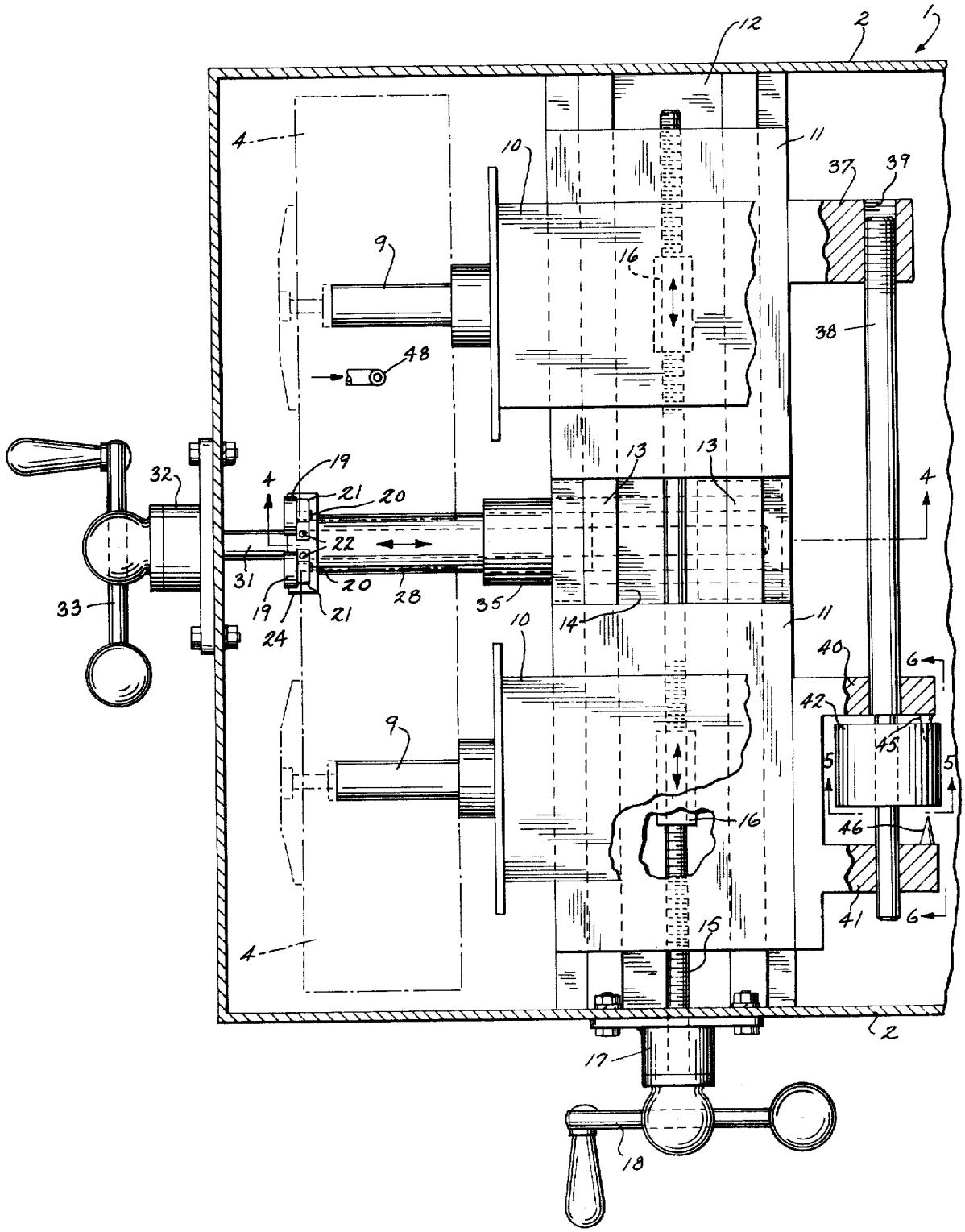
FIG. 3 is a section taken along line 3—3 of FIG. 2.

The drawings illustrate a honing machine which includes a cabinet or frame 1 composed of a base section 2 and an upper section 3. A pair of honing wheels 4 are mounted for rotation within the upper section 3, and during operation, the honing wheels are enclosed by removable covers 5. An access opening 6 is provided in the upper section 3 behind the honing wheels so that the knife or other tool being honed can be inserted between the wheels. A tray 7 extends forwardly from the upper portion of the base section 2.

Each of the honing wheels 4 is provided with a spiral or helical thread 8 and when the honing wheels are in the operating or honing position, as shown in FIG. 7, the threads 8 will be in mating or cooperating engagement. The honing wheels 4 are adapted to be moved laterally with respect to each other to an outer or dressing position, which is illustrated in FIG. 3.

Each honing wheel 4 is mounted on a shaft 9 which is journalled within a bearing assembly 10 mounted on a sliding carriage 11. The carriages 11 are mounted for sliding movement in a direction toward and away from each other on a plate 12 which extends across the base section 2. To guide the carriages in sliding movement, a pair of parallel guide bars 13 extend upwardly from the plate 12 and are received within guideway 14 formed in the bottom of the carriages 11.

To move the carriages 11 and honing wheels 4 in a direction toward and away from each other, a threaded shaft 15 is located between the guide bars 13 and is engaged with nuts 16 secured to the carriages 11. One of the nuts 16 has a right hand thread, while the other nut 16 has a left hand thread, so that as the shaft 15 is rotated, the carriages 11 will be moved in opposite directions, either to move the honing wheels 4 in a direction toward each other or in a direction away from each other.

The outer end of the shaft 15 is journaled within a bearing assembly 17 mounted on the wall of the base section 2 and a handle 18 is connected to the shaft. With this construction, rotation of the handle 18 in one direction will move the honing wheels 4 away from each other to the dressing position as shown in FIG. 3. Rotating the handle 18 in the opposite direction will move the honing wheels 4 toward each other, to the honing position shown in FIG. 7.

The dressing mechanism of the invention includes a pair of dressing wheels 19 which are encrusted with diamond fragments. Each dressing wheel 19 is mounted on a shaft 20 which is secured within a split block 21 by a set screw 22. The dressing wheels 19 and shafts 20 are normally fixed so that the dressing wheels are not free to rotate, but by loosening the set screws 22 the dressing wheels can be rotated to compensate for wear.

Each of the split blocks 21 is mounted for sliding movement within a recess 23 formed in dressing block 24. To adjust the vertical position of each dressing wheel 19, a rod 25 is secured to each split block 21 and is threaded within an opening 26 in the lower end of the dressing block 24. Hand knobs 27 are mounted on the lower ends of the rods 25. By turning the knobs 27, the split blocks 21 can be moved vertically within the recesses 23 to thereby adjust the vertical position of the dressing wheels 19.

During the honing operation, the dressing wheels 19 and dressing block 24 are normally positioned against the front wall of the base section 2 where they will not interfere with the honing operation. During the dressing operation, the dressing wheels are moved in a front-to-rear direction and each of the dressing wheels will ride across the surface of the respective honing wheel 4. To provide this front-to-rear travel, a tube 28 is secured within an opening in the dressing block 24. As shown in FIG. 2, the lower end of the dressing block is provided with a slit 29 which enables the tube to be received within the opening in the block and a set screw 30 serves to clamp the dressing blcok 24 to the tube 28.

As shown in FIG. 4, a shaft 31 is threaded within the tube 28 and the outer end of the shaft extends through the front wall of the base section 2 and is journaled within a bearing assembly 32. A handle 33 is secured to the outer end of shaft 31.

Tube 28 is connected by a spline 34 to the interior of a tube 35 and the inner end of tube 35 is secured to the vertical leg of the generally L-shaped bracket 36 which is secured to the plate 12. With this construction, rotation of the shaft 31 through operation of the handle 33 will move the tube 28 and the dressing block 24 in a front-to-rear direction to thereby move the dressing wheels 19 across the surfaces of the respective honing wheels 4, when the honing wheels are in the dressing position.

The dressing mechanism includes a provision for automatically positioning the honing wheels 4 in the proper position for the dressing operation, and for automatically aligning the honing wheels in the honing position after dressing by compensating for the amount of material removed during the dressing operation. To provide this function, a block 37 extends outwardly from the rear edge of plate 12 and the end of rod 38 is threaded within an opening 39 in block 37. As shown in FIG. 3, rod 38 extends parallel to the rear edge of plate 12 and is freely disposed within aligned openings in a pair of projections 40 and 41 which are formed integrally with one of the carriages 11 that carries a honing wheel 4. Secured to the rod 38 is a stop 42 that is positioned between the projections 40 and 41. Engagement of the projections 40 with the stop 42 limits the outward stroke of movement of the carriages 11 and determines the dressing position of the wheels 4, while engagement of projection 41 with stop 42 will limit the inward stroke and determine the honing position of the wheels 4.

Stop 42, as illustrated in FIG. 5, is provided with a series of circularly spaced holes 43 and, as shown in FIG. 6, the ends of each hole are beveled or tapered as indicated by 44. The beveled surface 44 of each hole 43 abuts or is in contiguous relation with the beveled surface of the adjacent holes, as illustrated in FIG. 5.

A wedge-shaped pin 45 is mounted on projection 40 and is adapted to engage one of the holes 43 as the projection 40 moves toward the stop 42. Similarly, a pin 46 is mounted on projection 41 and is adapted to engage the opposite end of the hole 43, as the projection 41 is moved toward stop 42. As best shown in FIG. 6, each pin 45 and 46 has a tapered edge 47 which engages the beveled surface 44 of the hole and engagement of the tapered edge 47 with the beveled surface 44 acts to rotate the stop 42 and rod 38 as the pin moves into the hole. Rotation of the rod 38 with respect to the fixed block 37 and plate 12 serves to relocate the position of stop 42. The pins 45 and 46 are out of phase angularly in an amount equal to approximately one-half the spacing between adjacent holes 43. This results in the stop 42 being rotated through an arc equal to half the distance between adjacent holes as it is engaged with the pin 45 on outward movement of carriages 11 and wheels 4. On inward or return movement of the honing wheels 4 and carriages 11, the pin 46 will engage a hole 43, to similarly index the stop 42 through an arc equal to one-half the spacing between adjacent holes 43.

In the dressing operation, the handle 18 is rotated to move the honing wheels 4 and carriages 11 apart. As the carriages move outwardly, the pin 45 on projection 40 will engage the beveled edge 44 of one of the holes 43, thereby rotating the stop 42 through an arc equal to one-half the distance between holes 43 and thus repositioning the stop with respect to the fixed plate 12. Engagement of projection 40 with the stop will limit the outward stroke of movement of the carriages and honing wheels.

With the honing wheels in the outer or dressing position, the dressing wheels 19 are then moved rearwardly through operation of the handle 33 to dress the rotating wheels 4. After the dressing operation, handle 18 is rotated in the opposite direction to move the honing wheels 4 and carriage 11 toward the honing position. As the honing wheels 4 approach the honing position, the pin 46 on the projection 41 will engage the beveled edge 44 of hole 43 thereby again causing the stop member 42 to index. Engagement of the projection 41 with the stop member will position the honing wheels 4 in proper position for honing. With this construction, each movement of the honing wheels 4 to the outer or dressing position and each return movement of the honing wheels will cause the stop 42 to be indexed to thereby adjust the stroke of lateral movement of the carriages and honing wheels. Each time the honing wheels are moved toward the dressing position, the spacing between the axes of the honing wheels will be decreased by an amount generally equal to the amount of surface removed in the last dressing operation and similarly, when the honing wheels are returned to the honing position, the spacing between the axes of the honing wheels will be decreased to compensate for the amount removed in the previous dressing operation.

During the honing operation, water can be supplied to the honing wheels 4 through a line 48 and the water is collected within a sump or reservoir 49 formed in the base section 2. Water from the sump is pumped through line 48 by a pump, not shown.

Figure 8:
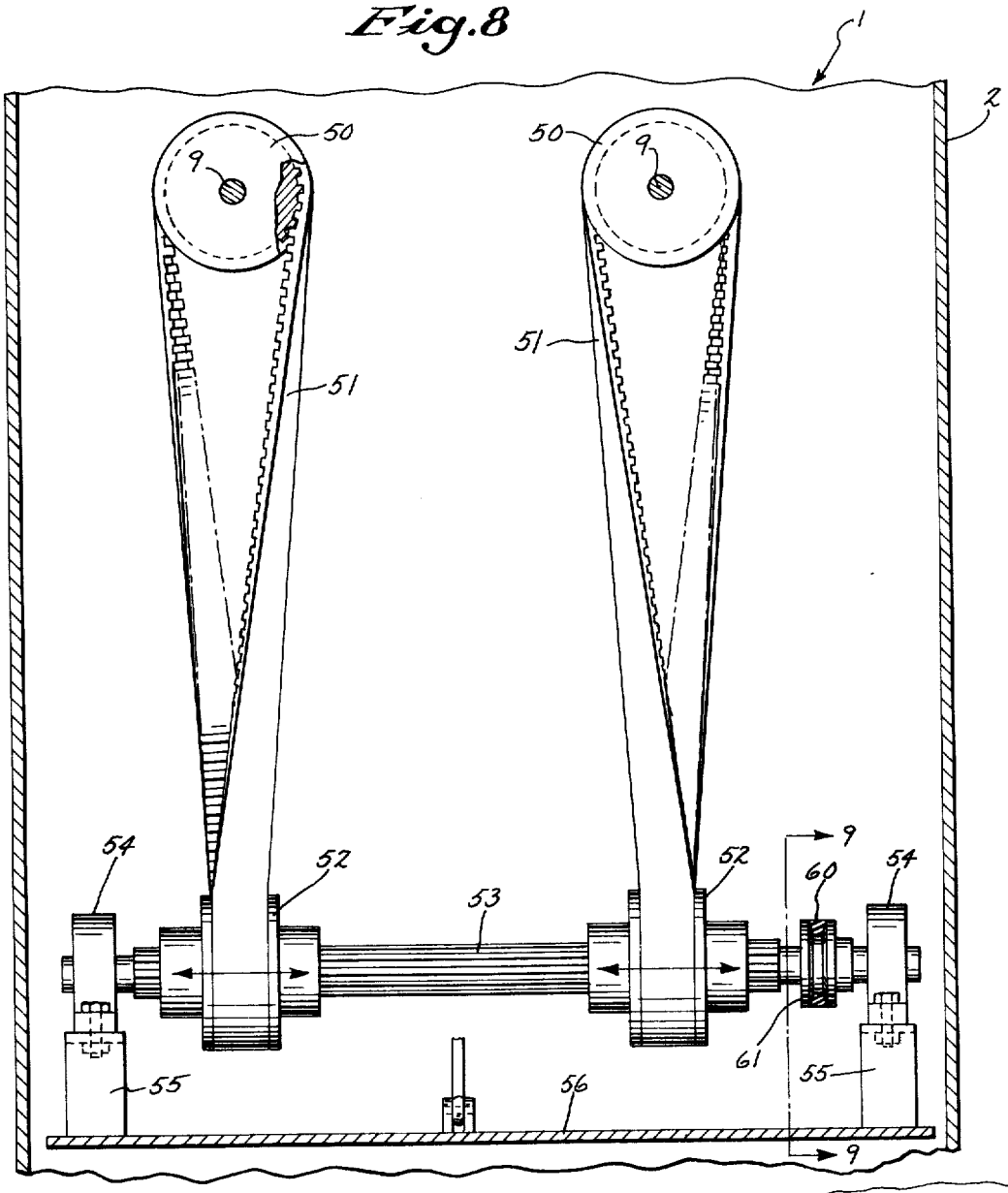
FIG. 8 is a rear view showing the drive mechanism for the honing wheels.
Figure 9:
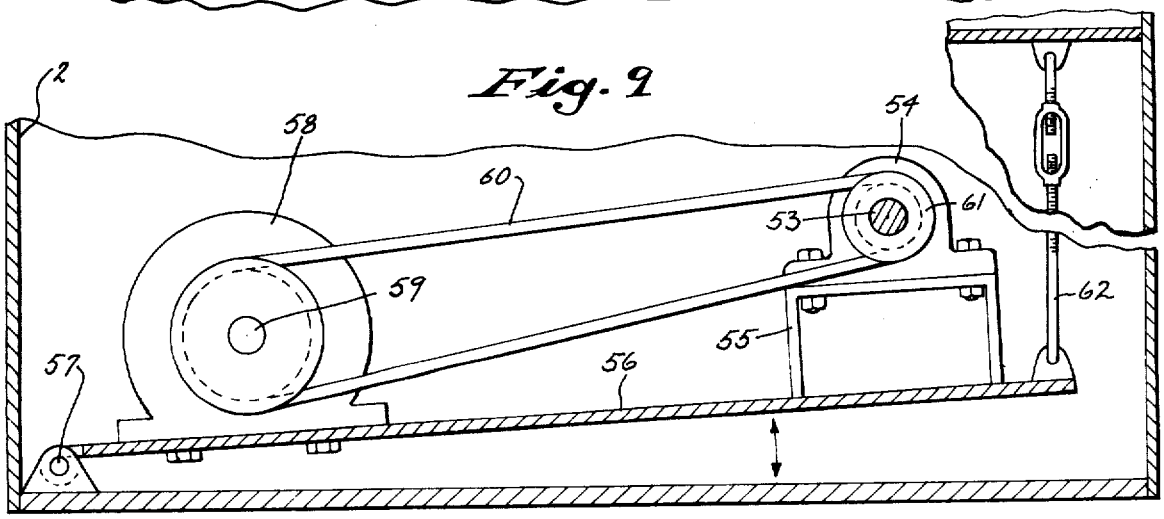
FIG. 9 is a vertical section showing the mounting structure for the motor and drive mechanism.

As illustrated in FIG. 8, the rear end of each shaft 9 carries a sprocket 50 which is connected by a timing belt or cog belt 51 to a sprocket 52 which is slidably engaged with a splined shaft 53. The axes of shafts 9 are disposed normal to the axis of shaft 53 and the belts 51 are twisted in opposite directions, as shown in FIG. 8. The ends of the shaft 53 are journalled within bearing blocks 54 mounted on the upper ends of U-shaped brackets 55. The brackets 55 are carried on a platform 56 which is pivotally connected to the cabinet 1 by pivots 57.

A motor 58 is mounted on the platform 56 and the output of shaft 59 of the motor is connected through belt 60 to sheave 61 on shaft 53 to drive the shaft.

Proper tension is maintained on the cog belts 51 by means of a turnbuckle 62 which connects the rear edge of platform 56 to the cabinet 1. Through operation of the turnbuckle 62, the platform 56 can be raised or lowered to adjust the tension on belts 51.

The drive system enables the driving connection to be maintained under proper tension as the honing wheels are moved between the honing position and the outer dressing position. When the honing wheels are moved outwardly, the sprockets 52 will freely move outwardly along the spline shaft 53, following the movement of the respective honing wheels 4. Conversely, as the honing wheels are moved toward each other, the sprockets 52 will follow this movement along the shaft 53. Thus, the drive mechanism automatically maintains the proper driving connection to the honing wheels as they are moved between their honing and dressing positions. This drive mechanism eliminates the need for a transmission or other costly and involved drive systems.

The honing apparatus of the invention incorporates a dressing apparatus which automatically indexes the wheels to the proper position for dressing and automatically indexes the honing wheels in proper alignment for honing, with compensation being made for the amount of material removed during the dressing operation. This eliminates the necessity of the operator having to visually adjust the position of the dressing wheels with respect to the honing wheels to provide proper dressing and further eliminates the necessity of the operator having to visually align the honing wheels after dressing for the subsequent honing operation.

Various modes of carrying out the invention are contemplated as being within the scope of the following claims particularly pointing out and distinctly claiming the subject matter which is regarded as the invention.

I claim:

1. An apparatus for performing a working operation on an article, comprising a supporting structure, a pair of rotating working members, carriage means for mounting the working members for movement between a working position in which the working members are in proximate relation and the article is inserted therebetween and an outer dressing position, means operably connected to said carriage means for moving the working members between said working position and said dressing position, dressing means for dressing the surfaces of the working members when in the dressing position, said dressing means comprises a pair of dressing members, each dressing member being mounted for movement along a path of travel to dress the surface of the respective working member, and indexing means for automatically adjusting the spacing between the working members each time the working members are moved to the dressing position and for automatically adjusting the spacing between the working members each time the working members are returned to the working position to compensate for material removed from the working members in the dressing operation.

2. The apparatus of claim 1, and including drive means for rotating each working member, said drive means comprising a driven shaft connected to each working member, a splined drive shaft operably connected to a source of power, a pair of splined members mounted on the spline drive shaft, and a connecting member connecting each splined member with the respective driven shaft, movement of said working members between said working position and said dressing position acting to move said spline members along said drive shaft to maintain the driving connection between said drive shaft and said driven shafts.

3. The apparatus of claim 1, wherein said indexing means includes a stop adjustably mounted with respect to the supporting structure, a pair of abutments associated with at least one of said working members, engagement of one of said abutments with the stop acting to limit the movement of the working members when moving toward the dressing position and engagement of the other of said abutments with said stop acting to limit the movement of said working members when moving toward the working position.

4. The apparatus of claim 3, wherein said indexing means includes means responsive to movement of said working members toward the dressing position for adjusting the position of said stop with respect to said supporting structure, and means responsive to movement of said working members toward said working position for adjusting the position of said stop with respect to said supporting structure, adjustment of the position of the stop serving to adjust the spacing between the working members in the working and dressing positions.

5. The apparatus of claim 3, wherein said abutments are located on opposite sides of said stop, each working member is mounted on a carriage and said abutments are mounted on one of said carriages.

6. The apparatus of claim 3, wherein said stop is mounted for rotation with respect to the supporting structure, and said indexing means includes a member connected to each abutment and engageable with the stop to rotate the stop through a predetermined arc and thereby adjust the position of the stop with respect to the supporting structure.

7. The apparatus of claim 6, wherein said stop is provided with a plurality of circularly arranged openings, and said member comprises an indexing pin and adapted to engage one of said openings as the corresponding abutment moves toward said stop to thereby rotate said stop.

8. The apparatus of claim 7, wherein the outer edge bordering each opening is beveled and each indexing pin is provided with an inclined surface adapted to engage said beveled surface to rotate said stop.

9. A honing machine comprising a supporting structure, a pair of rotatable honing wheels, a carriage to support each honing wheel, means for mounting the carriages for movement whereby the honing wheels can be moved laterally between an inner honing position and an outer dressing position, means for moving the honing wheels between the honing position and the dressing position, dressing means for dressing the outer surface of the honing wheels when in the dressing position, a stop connected to the supporting structure and adjustably mounted for movement with respect to said supporting structure, a pair of abutments connected to one of said carriages with one of said abutments disposed to engage a face of the stop when the honing wheels are moved toward the dressing position and the other of said abutments disposed to engage a second face of the stop as the honing wheels are moved toward the honing position, each of said faces having a series of circularly spaced holes with the outer edge of each hole being beveled, and an indexing pin operably connected to each abutment, each indexing pin facing the corresponding face of the stop and adapted to engage the beveled edge of a hole of the stop as said abutment is moved toward the stop to thereby rotate the stop through a predetermined arc and thereby adjust the position of the stop with respect to the supporting structure, adjustment of the position of the stop acting to automatically adjust the dressing position and the honing position of the wheels.

10. The apparatus of claim 9, wherein each pin is provided with an inclined surface adapted to engage the beveled edge.

11. The apparatus of claim 9, wherein said pins are angularly offset.

12. The apparatus of claim 9, wherein the beveled edge of each hole is in contiguous relation with the beveled edges of adjacent holes.

13. The apparatus of claim 9, wherein the stop is mounted on a rod that is threadedly connected to the supporting structure.

14. The apparatus of claim 9, wherein the dressing means comprises a supporting member, a pair of dressing members, and means for moving the support member in a path of travel generally parallel to the axes of the honing wheels, each of said dressing members disposed to ride across the surface of one of said honing wheels to dress the same as the support member is moved in said path of travel.

15. The apparatus of claim 14, wherein each dressing member comprises a diamond encrusted dressing wheel, and said dressing means includes means for adjustably mounting each dressing wheel with respect to the supporting member.

16. An apparatus for performing a working operation on an article, comprising a supporting structure, a pair of rotatable working members, means for mounting the working members for movement between a working position in which the working members are in proximate relation and the article is inserted therebetween and an outer dressing position, means for moving the working members between said working position and said dressing position, dressing means for dressing the surfaces of the working members when in the dressing position, and drive means for rotating each working member, said drive means comprising a driven shaft connected to each working member, a splined drive shaft operably connected to a prime mover, a pair of splined members connected to the drive shaft, and a connecting member connecting each spline member with the respective driven shaft, movement of said working members between said working position and said dressing position causing said splined members to move freely along said drive shaft to retain the driving connection between the drive shaft and the driven shafts.

17. The apparatus of claim 16, wherein the axes of said driven shafts are disposed normal to the axis of said drive shaft.

18. The apparatus of claim 17, wherein said connecting members are cog belts, said belts being twisted in opposite directions.

19. The apparatus of claim 18, and including a platform pivotally connected to the supporting structure, said prime mover and said drive shaft being mounted on said platform, and means for pivoting said platform with respect to the supporting structure to adjust the tension on said cog belts.

* * * * *